US005294125A

United States Patent [19]

Mietz

[11] Patent Number: 5,294,125

[45] Date of Patent: Mar. 15, 1994

[54] GOLF TRAINING AID

[76] Inventor: Dennis R. Mietz, 320 Julia Cir. North, Saint Petersburg Beach, Fla. 33706

[21] Appl. No.: 10,331

[22] Filed: Jan. 28, 1993

[51] Int. Cl.[5] ..... A63B 69/36

[52] U.S. Cl. ..... 273/187 R

[58] Field of Search ..... 273/187 R, 187 A, 187 B, 273/187.1, 195 R

[56] References Cited

U.S. PATENT DOCUMENTS 3,041,075 6/1962 Taylor ..... 273/187 R
3,920,248 11/1975 Medders ..... 273/187 R
4,478,422 10/1984 Blanchard ..... 273/187 R
4,718,674 1/1988 Henry ..... 273/187 R X

FOREIGN PATENT DOCUMENTS 2382907 10/1978 France .

*Primary Examiner*—George J. Marlo
*Attorney, Agent, or Firm*—David Kiewit

[57] ABSTRACT

A readily portable golf training aid consisting of six flexible segments and a number of intermediate eyelets can be anchored to the ground (e.g. with golf tees) to provide a fixed and visible reference that any player can use for a shot made with any club. This device provides a consistent framework for building a "muscle memory" of desired hip and shoulder rotations that is important to learning the game of golf.

7 Claims, 1 Drawing Sheet

GOLF TRAINING AID

BACKGROUND OF THE INVENTION

The present invention provides a device for training a golfer to take a consistent stance when lining up a golf shot. Notable among the prior art in this area are the patents to Henry, to Blanchard, to Medders, and to Goubaux that are discussed below.

In U.S. Pat. No. 4,478,422 Blanchard teaches a "figure-four" arrangement of cord segments that defines an aiming line from the golfer to a target. Blanchard's aiming line is also a toe-line along which the golfer's feet are placed. Blanchard's graduated cord is readily portable, and uses clips on the cord at various positions to indicate proper toe and golf ball positions for each club. Blanchard provides no assistance to a golfer who needs to learn how to build consistent hip and shoulder rotations into a stroke.

In U.S. Pat. No. 4,718,674 Henry teaches a frame that helps a golfer set his or her feet along a toe-line or bar that is parallel to a separate aiming line or bar. Since Henry's aiming line is spaced apart from the toe-line it is likely to be more visible to the golfer than is Blanchard's. Henry's frame, which is comprised of numerous rigid segments, is of marginal portability and provides no guidance to the user in learning proper and consistent hip and shoulder rotations.

In published French patent application 2,382,907, Goubaux provides an inflatable frame structure that uses a combination of mirrors to aid in training a golfer to take a repeatable stance in order to build muscle memory. His teaching is directed at getting the golfer to maintain a fixed head and foot position and to move his or her hands and club-head in a single plane. Goubaux provides no teaching about hip and shoulder rotations.

In U.S. Pat. No. 3,920,248 Medders teaches a training device consisting of three straps. Two of the straps are sewn together into the shape of a capital T and the third strap is attached with a D ring at the top of the T. The strap that is the crossbar of the T is used as an aiming line, and the angle that the third strap makes with this aiming line is adjustable so that the golfer can intentionally slice or hook the ball by swinging his club's head along the third strap.

SUMMARY OF THE INVENTION

It is an object of the invention to provide a golf stance and swing training device to aid a golfer in taking a consistent stance and in rotating his or her shoulders a consistent amount during each swing.

It is a further object of the invention to provide a golf stance and swing training device that will train a golfer to take a consistent stance and to rotate his or her hips a consistent amount on each swing.

It is an additional object of the invention to provide a golf training aid that teaches a golfer to take a consistent stance and to locate his or her golf ball at a selected position with respect to the stance, where the selected position varies with the choice of club.

DETAILED DESCRIPTION

Figure 1:
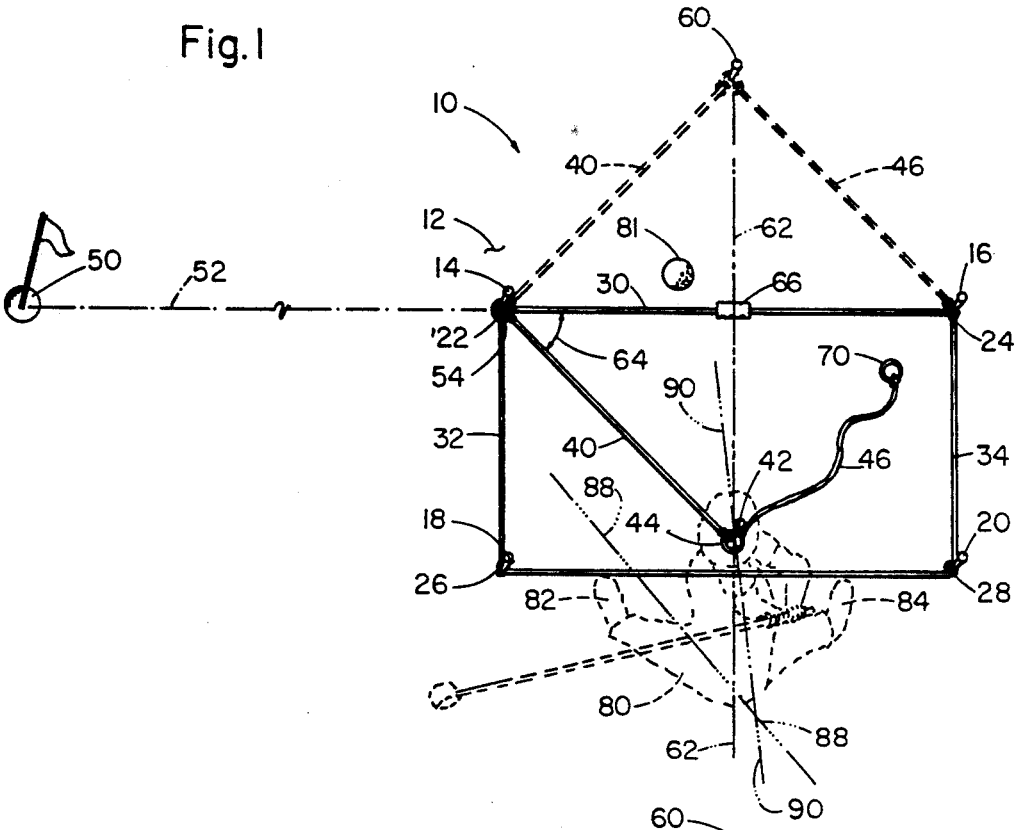
FIG. 1 of the drawing is an elevational view of the training device of the invention, and shows both a golfer (in phantom) and various fictitious lines used in the training process. In this view a parallelogram is formed from four cord segment with rings or loops between them. The rings or loops, which comprise the apices of the parallelogram, are held to the ground by four golf tees.

Turning initially to FIG. 1 of the drawing, one finds a view of a golf training aid 10 that is anchored to the ground 12 by four golf tees 14, 16, 18, 20 inserted through eyelets 22, 24, 26, 28 at the ends of four taut cord segments 30, 32, 34, 36 that form the sides of a parallelogram 38. A fifth taut cord segment 40 is shown anchored by a fifth golf tee 42 that is also inserted through a eyelet 44. An additional cord segment 46 that is shown lying loosely on the ground 12 is employed in laying out the training aid 10, as will be subsequently discussed.

Figure 2:
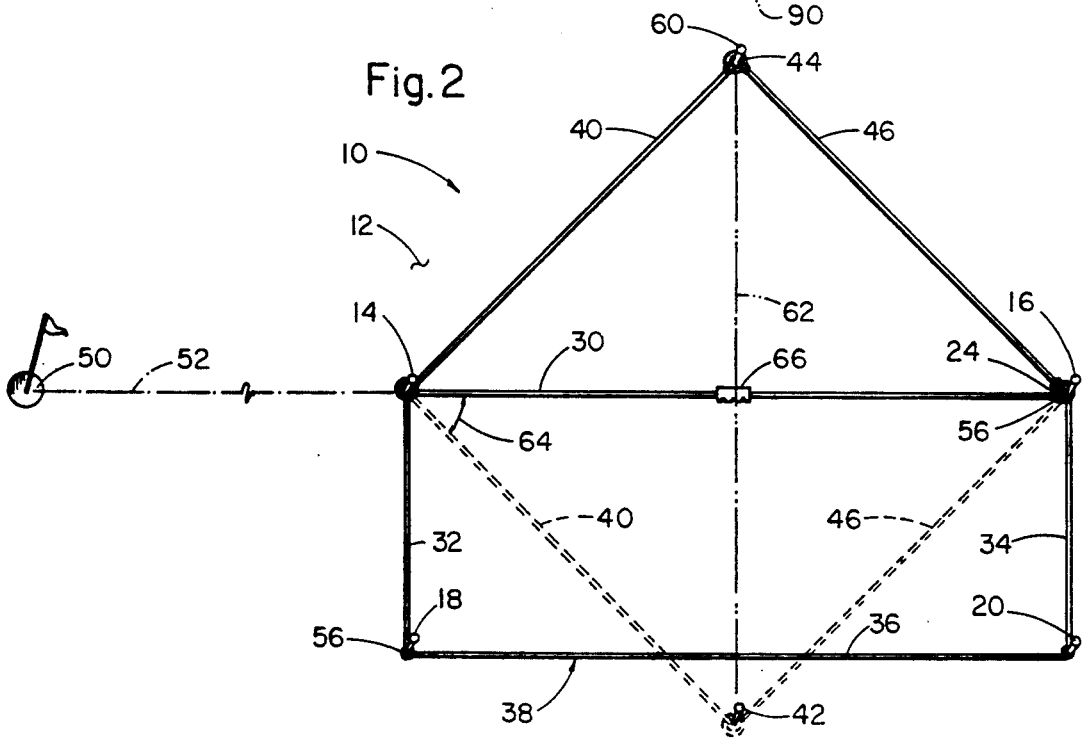
FIG. 2 of the drawing is an elevational view showing an intermediate step in the installation of a training device.

It should be noted that various of the eyelets 22, 24, 26, 28, 44, 70 that are used in the training aid may be a separate component (e.g. a metal ring 54, as shown at the end of the hip-line segment 40 in FIG. 1), or may be integrally formed in the cord or line as a knotted loop (e.g. as indicated by 56 in FIG. 2). Moreover, the various line segments 30, 32, 34, 36, 38, 40, 46 may be formed as portions of a single cord, rope, tape or the like (e.g. where the segments are separated by knotted loops 56 as shown in FIG. 2) or may be entirely separate elements. That is, the training aid 10 may be made of a single piece of cord, or way be made from as many as six different pieces of tape, line, or the like. Moreover, although a golfer may well find a golf tee to be the most convenient means of anchoring the ends of the various line segments to the ground, it will be understood that a variety of other well known anchoring methods may be used.

The installation of the training aid 10 is illustrated in FIG. 2 of the drawing, which shows an intermediate stage of the process. As a first step in the installation, the golfer inserts a first golf tee 14 through an eyelet 22 that is at one end of an aiming line segment 30 of cord, twine, tape or other flexible material, and then pulls the segment 30 taut and anchors the other end of it with a second tee 24 while aiming along the segment 30 at a target 50, thus defining a fictitious aiming line 52 that includes the aiming line segment 30 as a portion thereof. In the second step the golfer draws either the front segment 32 or the back segment 34 taut in a direction that may be as close to perpendicular to the aiming line segment 30 as the golfer may judge by eye (If the golfer is right-handed, as is assumed for this discussion and for the illustrations provided herewith, he draws the segment 32 or 34 in a sense that is determined by keeping his left shoulder toward the target. If he is left-handed, he keeps his right shoulder toward the target during this step.). After anchoring either the front segment 32 or back line segment 34 with tee 18 or 20, the golfer draws the other such cord taut and anchors it. Since the front line segment 32 and back line segment 34 are of equal length, and the aiming line segment 30 and toe-line segment 36 are also of equal length, this process defines a parallelogram 38 having the various cord segments as its sides.

It has been found that the training aid 10 accommodates a wide range of golfers having different body sizes and different stroking preferences when the aid 10 is set up as a quasi-rectangle, as shown in the drawing. Some golfers, especially children and short adults, find the distance between the aiming 30 and toe 36 lines to be too far apart when the aid 10 is configured as a quasi-rectangle. In these cases the aid 10 can be installed with the aiming line 30 and toe line 36 closer together by letting the angle between the aiming line 30 and front line 32 depart from an approximate right angle.

Once the parallelogram 38 has been constructed by the golfer, he or she then proceeds to use additional cord segments 40, 46 to define several lines that are a key part of the present training aid 10. The cord segments 40 and 46 are each made with a preselected length equal to $\sqrt{2}/2$ (the square root of two divided by two) times the length of the aiming segment 30, or a length approximately equal to the quotient formed by dividing the length of aiming line 30 by the square root of two. Hence, if the golfer attaches the outer ends of these segments to anchors 14 and 16, grasps the eyelet 44 that separates the segments 40 and 46 and then pulls segments 40 and 46 taut in a direction away from the toe-line 36, and places a marker tee 60 at eyelet 44, he or she thereby constructs a right triangle having the aiming line 30 as a hypotenuse, as is shown by the solid lines in FIG. 2. In the next step, the golfer removes eyelet 44 from the position where the marker 60 was placed and pulls on eyelet 44 in a direction toward the toe-line 36 until both cord segments 40, 46 are taut (this position of the cord segments 40, 46 is shown in phantom in FIG. 2). At this point a marker or anchor 42 is inserted in tile ground 12, thereby defining a second right triangle having the aiming line 30 as its hypotenuse.

As is known from trigonometry, the above series of steps provides a fictitious center line 62 that is a perpendicular bisector of the aiming line segment 30, and also ensures that the angle 64 between the hip-line segment 40 and the aiming line segment 30 is forty-five degrees of arc. In the case described above, the fictitious center line is marked with marker 60 and anchor 42. As is shown in FIG. 2, one can fabricate the aiming line segment 30 with a marker element 66 located at the mid-point of the segment 30. If this is done, there are three markers defining the fictitious center line 62, and the golfer finds the mental task of imagining the position of the fictitious line 62 to be easier.

After the steps recited above have been completed the line segment 46 may be left in the position shown in phantom in FIG. 2; it may be detached from the anchor 16 and allowed to lie in a convenient out of the way position (e.g. FIG. 1); or an eyelet 70 at the free end of this segment can be dropped over the tee 14 at the front of the aiming line segment 30.

A right-handed golfer 80 who uses the training aid 10 can now take a position approximately at the center line 62 of the training aid 10, as shown in phantom in FIG. 1 of the drawing (It will be understood in the following that the situation for a left-handed golfer (not shown) who set up the training aid 10 as discussed above can be readily determined from considerations of symmetry.). The golfer places his or her golf ball 81 at a location towards the target 50 from the center line 62 and on the side of the aiming line 52 that is away from the toe-line 36. The golfer's toes 82, 84 are then aligned with the toe-line 36 at a position that varies both with the golfer's preferences and with the choice of club. If a driver or long iron is being used, the stance is widened and toes 82 are moved closer to the front line 32; if a wedge is being used, the stance is narrowed and toes 82 and 84 are closer to the center line 62. In any event, the aid 10 encourages the golfer to take a consistent initial stance that is symmetrical about the center line 62, and to then widen or narrow that stance to suit the choice of club.

In the backswing, the golfer's hips ideally turn 45°, which brings a fictitious hip-to-hip line 88 drawn through the golfer's hips into a parallel alignment with the hip-line segment 40 (The golfer in FIG. 1 is shown with a non-ideal alignment in which the hip-to-hip line 88 is skewed with respect to the hip-line 40). At the same time, the golfer's shoulders should turn 90°, which brings a fictitious shoulder-line 90 into parallel alignment with the fictitious center line 62 (Again, the golfer in FIG. 1 is shown with a non-ideal alignment in which the shoulder-shoulder line 90 is skewed with respect to the centerline 62). Note that if the aid 10 has been constructed as a quasi-rectangle, the ideal shoulder line 90 will be similarly aligned with the front 32 and back 34 line segments of the aid 10.

It should be noted that not all golfers follow the ideal prescription and rotate their hips and shoulders through standard angles, nor is the same angle used by a given golfer for all shots. In some cases (e.g. an older golfer whose body lacks the flexibility for a full rotation, or a golfer using a short iron) a lesser rotation is used. In other cases (e.g. a younger golfer, or a golfer playing a driver or a long iron) a greater rotation is used. In any of these events the training aid 10 provides a fixed and visible reference that any player can use for a shot made with any club. That is, the device of the invention provides a consistent framework for building the "muscle memory" that is important to learning the game of golf.

Although the present invention has been described with respect to several preferred embodiments, many modifications and alterations can be made without departing from the invention. Accordingly, it is intended that all such modifications and alterations be considered as within the spirit and scope of the invention as defined in the attached claims.

What is desired to be secured by Letters Patent is:

1. A practice aid for a golfer including a plurality of segments and a plurality of eyelets, each said eyelet adapted for the insertion of an anchoring device therethrough, each said eyelet at an end of a said segment, said aid comprising a first, aiming-line, segment having a first predetermined length, said aiming-line segment extending between a first eyelet and a second eyelet, a second, front-line, segment having a second predetermined length, said front-line segment extending between said first eyelet and a third eyelet, a third, back-line, segment having said second length, said back-line segment extending between said second eyelet and a fourth eyelet, and a fourth, toe-line, segment having said first length, said toe-line segment extending between said third eyelet and said fourth eyelet, a fifth, hip-line, segment having a third length approximately equal to the quotient formed by dividing said first predetermined length by the square root of two, said hip-line segment having a fifth eyelet at a first end thereof, wherein said fifth eyelet is adapted for the insertion of an anchoring device therethrough, said hip-line segment having attachment means at a second end thereof, said attachment means adapted to co-anchor said second end of said hip-line segment with said first eyelet, a sixth segment having said third length, said sixth segment extending from said fifth eyelet to a sixth eyelet, whereby said golf aid may be anchored to the ground to form a composite geometrical figure comprising a parallelogram having said aiming-line segment as a side thereof, said aiming-line co-linear with a fictitious line extending from said first eyelet to a target, said hip-line segment extending from an apex, at said first eyelet, of said parallelogram, said hip-line segment extending toward the center of said parallelogram at a forty-five degree angle to said aiming-line side of said parallelogram, and a fictitious perpendicular bisector line bisecting said aiming-line side of said parallelogram, said fictitious perpendicular bisector line denoted by a plurality of markers.

2. The training aid of claim 1 further comprising a marker element attached to the midpoint of said aiming-line segment.

3. The training aid of claim 1 wherein said attachment means at said second end of said hip-line segment comprises a seventh eyelet.

4. The training aid of claim 1 wherein said attachment means at said second end of said hip-line segment comprises said first eyelet.

5. The training aid of claim 1 wherein said aiming-line, said front-line, said back-line, said toe-line, said hip-line and said sixth segments are formed from a single piece of flexible material and wherein said first, said second, said third, said fourth, said fifth and said sixth eyelets comprise knotted loops formed in said flexible material.

6. The training aid of claim 1 wherein said aiming-line, said front-line, said back-line, and said toe-line segments are formed from a first piece of flexible material and wherein said hip-line segment and said sixth segment are formed from a second piece of flexible material.

7. The training aid of claim 1 wherein said aiming-line, said front-line, said back-line, said toe-line, said hip-line and said sixth segments are each formed from a separate piece of a first, flexible material and wherein said first, said second, said third, said fourth, said fifth and said sixth eyelets comprise rings formed of a second material.

* * * * *